US008810991B2

(12) United States Patent
Scharnick

(10) Patent No.: US 8,810,991 B2
(45) Date of Patent: Aug. 19, 2014

(54) SAFETY ISOLATION SYSTEMS AND METHODS FOR SWITCHING DC LOADS

(75) Inventor: Michael Scharnick, Brookfield, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 893 days.

(21) Appl. No.: 12/898,108

(22) Filed: Oct. 5, 2010

(65) Prior Publication Data

US 2012/0081829 A1 Apr. 5, 2012

(51) Int. Cl.
*H01H 47/00* (2006.01)

(52) U.S. Cl.
CPC ..... *H01H 47/005* (2013.01)
USPC ..... 361/169.1; 361/115

(58) Field of Classification Search
CPC ..... H01H 9/548
USPC ..... 361/3, 115, 169.1; 324/422; 340/638, 340/644
See application file for complete search history.

(56) References Cited

U.S. PATENT DOCUMENTS 3,407,340 A * 10/1968 Hufnagel ..... 361/196
3,641,357 A 2/1972 Gratzmuller
4,636,907 A * 1/1987 Howell ..... 361/13
4,760,384 A * 7/1988 Vila-Masot ..... 340/638
4,969,063 A * 11/1990 Scott et al. ..... 361/93.1
4,975,800 A * 12/1990 Oshita et al. ..... 361/113
4,977,478 A * 12/1990 Powell ..... 361/160
5,182,456 A * 1/1993 Beezley ..... 250/551
5,343,192 A * 8/1994 Yenisey ..... 340/639
5,455,733 A * 10/1995 Waggamon ..... 361/115
5,633,540 A * 5/1997 Moan ..... 307/126
5,886,641 A * 3/1999 Ulerich et al. ..... 340/638
6,011,327 A 1/2000 Cook et al.
6,611,416 B1 8/2003 Cleereman et al.
7,420,297 B2 9/2008 Scharnick
7,495,952 B2 * 2/2009 Lal et al. ..... 365/164
7,538,990 B2 * 5/2009 Belisle et al. ..... 361/2
7,602,617 B2 10/2009 Brandt et al.
7,612,471 B2 * 11/2009 Schasfoort ..... 307/132 E
7,612,972 B2 11/2009 Battani et al.
8,035,528 B2 * 10/2011 Acharya et al. ..... 340/644
8,284,528 B2 * 10/2012 Koshin et al. ..... 361/2
8,350,414 B2 * 1/2013 West ..... 307/85
8,432,650 B2 * 4/2013 Seger ..... 361/54
2005/0024218 A1 * 2/2005 Cuk ..... 340/638
2006/0072265 A1 4/2006 Bucella et al.
2007/0041142 A1 * 2/2007 Lal et al. ..... 361/207
2007/0061019 A1 3/2007 Scharnick et al.
2007/0244579 A1 10/2007 Scharnick et al.
2008/0143462 A1 * 6/2008 Belisle et al. ..... 335/201
2010/0232082 A1 * 9/2010 Seger ..... 361/211

OTHER PUBLICATIONS

Moeller GmbH "Mirror Contacts for Highly-Reliable Information Relating to Safety-Related Control Functions" pp. 1-12, Oct. 2004.

(Continued)

*Primary Examiner* — Ronald W Leja
(74) *Attorney, Agent, or Firm* — Quarles & Brady LLP

(57) ABSTRACT

Safety isolation systems and methods adapted for switching DC electrical power applications, including high voltage DC, are provided. A contactor is in series with a solid state DC switch and a switching circuit controls the operation of the contactor and the solid state DC switch. Mirror contacts may be added to the system that are capable of providing a reliable indication about the open/closed status of the main contacts of the contactor.

23 Claims, 7 Drawing Sheets

(56) References Cited

OTHER PUBLICATIONS

Rockwell Automation "ElectroGuard Safety Isolation System Bulletin 2030" pp. 1-11, Aug. 2003.
GE "DC Contactors" p. 1, 1997-2010.
Rockwell Automation "Bulletin 100S/104S Safety Contactors" p. 1, 2008.
Rockwell Automation "100S-D Safety Contactors-95 . . . 860-A" p. 1-2, Apr. 2002.
SSD Drives "590+ Armature DC Contactor Option" pp. 1-2, 2008.
Rockwell Automation "Bulletin 100-D IEC Contactors" p. 1, 2008.
Eaton "Reversing DC Control Contactors" pp. 1-2, 2006.
Allen Bradley "Contactors & Control Relays Safety Control Relays 7005-CF" pp. 9-17-9-28, 2010.

* cited by examiner

SAFETY ISOLATION SYSTEMS AND METHODS FOR SWITCHING DC LOADS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates generally to control systems for industrial automation applications, and, more particularly, to safety isolation systems adapted to connect, disconnect, and isolate direct current (DC) electrical power.

In a variety of environments, including for example industrial automation environments, there is a need for control systems that are capable of governing the operation of one or more pieces of industrial equipment or machinery in a manner that is highly reliable. Such control systems often employ a high degree of redundancy in their various circuits and other components, so as to guarantee or nearly guarantee that the control systems will achieve intended goals in operating the controlled equipment/machinery and, in the event of failures, that the control systems will operate in such manners that the control systems and the controlled equipment/machinery enter predicted failure states.

Among these control systems are systems generally referred to as safety isolation systems that are designed to disconnect, ground and otherwise isolate controlled equipment/machinery from one or more power sources in a predictable, reliable manner. Such control systems reduce the chance that the controlled equipment/machinery might be unintentionally restarted at times when it is being accessed by repair personnel or technicians for purposes of repair or modification, and thereby enhance the confidence and rapidity with which such personnel can accomplish such repairs/modifications. The power sources from which the controlled equipment/machinery are isolated by these control systems can include any of a number of power sources including, for example, electrical, pneumatic and hydraulic power sources.

Referring to FIG. 1, one prior known control system of this type is the ElectroGuard™. Bulletin 2030 Safety Isolation System available from Rockwell Automation, Inc. of Milwaukee, Wis., the beneficial assignee of the present application. This control system, shown in FIG. 1 as safety isolation system 10, includes both an electric power isolation system 12 and a pneumatic (or hydraulic) power isolation system 14, and operates as follows.

When it is desired to disconnect a machine 16 of an industrial system 18 (in this case, an assembly line) from a power source, or when a failure or other condition occurs at the machine 16 and an operator appropriately switches or triggers a remote lockout switch (RLS) 20 associated with that machine to an "OFF" position, the safety isolation system 10 serves to disconnect electric power and pneumatic power lines 22 and 24, respectively, from the machine so as to decouple and isolate the machine from both of those types of power. Additionally, the safety isolation system 10 may then further serve to ground the machine 16.

Once the machine 16 has been disconnected and isolated from the power source, an indication may be provided to the operator (e.g., a light 26 turns ON) indicating that it is appropriate for the operator to access the machine for purposes of making a repair or some other modification to the machine. Typically the operator will then access the machine by entering into a normally-inaccessible region, e.g., by opening a barrier 28 and entering into the machine as shown (alternatively, for example, the operator could pass through a light curtain).

Once the operator has completed the repair/modification and left the normally-inaccessible region, the operator appropriately switches or triggers the RLS 20 again, this time to an "ON" position. After this occurs, the safety isolation system 10 reestablishes the connections between the power sources and the machine 16. The safety isolation system 10 typically employs redundant circuitry such as safety relays to enhance the control system's reliability in performing its control functions in this regard.

Although control systems such as the safety isolation system 10 shown in FIG. 1 are useful, such control systems are typically designed to have only limited purpose(s) and functionality. For example, the safety isolation system 10 merely serves the purposes of disconnecting/connecting one or more loads from low voltage AC electric power (typically 600 VAC or less). In certain applications, however, it would be advantageous if such control systems could be reconfigured in a manner allowing for expanded functionality, particularly functionality involving control and monitoring of DC electrical power for DC operated equipment/machines/loads.

Despite the desirability of providing such additional functions in some circumstances, it is not possible to reconfigure conventional control systems such as the safety isolation system 10 adapted for low voltage AC electrical power to achieve such additional functions in the field. Largely this is because such conventional control systems are carefully designed for connecting and disconnecting AC electrical power and to include sufficient redundancy to enhance reliability and behave in predictable manners during failures. Reconfiguration of such conventional control systems in the field to allow for connecting and disconnecting of DC electric power loads could unpredictably alter the control systems' behavior and undermine the control systems' reliability, and consequently conventional control systems typically are designed in a manner that prevents such ad hoc reconfigurations. Some contactors (discussed below) have a DC switching rating but are limited to approximately 220 VDC and some contactors require their main contacts to be connected in series.

In addition, connecting and disconnecting of DC electrical power, especially high voltage DC (typically 220 VDC or more) and high current DC (typically hundreds of amps or more) requires special considerations due to the unique characteristics of the DC electrical power. One type of industrial automation device designed to connect/disconnect electrical power is known as a contactor. Contactors are designed for opening and closing electrical power feed lines. In an AC electrical power system, an electric current follows a waveform, typically a sine wave, and there exists a zero voltage cross over point on that waveform that helps to extinguish the arc. Because the AC voltage and current waveforms go through zero voltage and zero current, the arc problem described below that exists in DC electrical power systems will not occur.

In a DC electrical power system, there is no zero voltage cross over point. If a contactor is opened, an electric arc will form in a gas-filled space (including air) between the contacts, and without intervention will continue until the space between the electrical contacts is too large to sustain the arc. An arc can produce a very high temperature and is undesirable in most if not all industrial environments, as it can decrease the contactor's life span and can damage the contactor, including welding the contactor's main contacts.

One known solution to this arcing problem is to include an arc chute. The arc chute is used to stretch the arc a sufficient distance so that the voltage cannot support the arc, and the arc will eventually break. However in a DC system, such a contactor, including those designed specifically for DC applications, becomes undesirably large due to the size required for the arc chute and the large spacing required between the contacts within the contactor.

Another known solution to the DC arc problem is to create a hermetically sealed container to enclose the contacts. In this solution, the container is typically metal, and is typically soldered for an airtight seal. The container is then either hooked to a hard vacuum to remove air, or the container is filled with an inert gas. The absence of air decreases the distance that the arc can be maintained for the voltage in the atmosphere around the contacts. Side magnets are sometimes used in a hermetically sealed contactor to pull the arc and eventually break it. Not only does the hermetic cavity of this construction make the contactor undesirably large, it also makes the manufacture of the contactor difficult and costly.

In addition, in the last few years, the significance of safety-related circuits for both personal protection and the protection of high-value capital investments, such as industrial machinery, has become an even greater issue and an area of increased interest. The readiness for use of safety circuits exists, but there is frequently an element of uncertainty regarding the properties of contacts in the circuit, and specifically the interaction between the main contacts (for power) and the auxiliary contacts (for control). The required specifications of "mirror contacts" provide a reliable indication about the open/closed status of the main contacts of a contactor. Specifically, one requirement of a mirror contact is that a normally closed mirror contact will not change state if the main contacts weld. In the event that a main contact would weld, the normally closed mirror contact will not reclose when power is removed from the control coil of the contactor. With the special requirements as described above for DC contactors, mirror contacts have not been readily available on DC contactors. AC contactors with limited DC rating (low voltage DC and DC currents less than 420 A) are more prevalent with mirror contacts.

Given that it would be desirable for reliable, failure-resistant control systems such as the safety isolation system 10 to have the capability to connect/disconnect and isolate DC electrical power, and given that conventional systems of this type are not readily reconfigurable to provide such capabilities, it would be advantageous if an improved control system of this general type was developed that was capable of providing such capabilities. Further, it would also be advantageous if such an improved control system achieved greater levels of redundancy, reliability and failure-resistance as conventional control systems of this type through the incorporation of mirror contacts.

BRIEF SUMMARY OF THE INVENTION

The present inventors have recognized the need for a safety isolation system adapted for DC electrical power applications, and especially for high voltage DC applications where other forms of industrial control equipment are not capable of performing this function. The present inventors further have recognized that, in some embodiments, such an improved safety isolation system could be achieved by adding mirror contacts to the system, where the mirror contacts were capable of providing a reliable indication about the open/closed status of the main contacts of a contactor.

The present embodiments addresses the problems associated with DC electrical power applications, including the DC arc formation, through the use of a safety isolation system comprising a mechanical contactor in series with a high voltage solid state DC switch. The solid state DC switch is used to connect and disconnect the DC electrical power from the load, thereby reducing or eliminating the formation of an arc within the mechanical contactor. The mechanical contactor in series with the solid state DC switch provides an air gap (when control power is removed from the control coil and the main contacts are open) to eliminate the flow of any leakage current from the solid state DC switch, so as to provide complete isolation of the DC electrical power from the load. In one embodiment, when an industrial automation system requires DC electrical power, the control coil of the contactor is first energized, thereby closing the main contacts, but the electrical circuit of the system remains open because the solid state DC switch is open (with the possibility of a small leakage current). Once the main contacts on the contactor close, the solid state DC switch is closed, thereby closing the circuit and allowing the DC electrical power to flow through the contactor in series with the solid state DC switch and to the DC load.

When DC electrical power is to be removed, the solid state DC switch is opened first to stop the DC current flow before the contactor in series is opened. When the main contacts are to be opened, the solid state DC switch is first confirmed to be open, which virtually eliminates the flow of current through the main contacts so that no arc is formed when the main contacts are opened.

In accordance with one aspect of the invention, a safety isolation system adapted to connect, disconnect, and isolate a DC electrical power, is provided. The system comprises at least one mechanical contactor, the contactor including a control coil and a main contact, the main contact including an open position and a closed position, the main contact forming an air gap so that no current flows through the contactor when the main contact is in the open position, and the main contact forming a current flow path through the contactor when the main contact is in the closed position. A solid state DC switch is electrically coupled to and in series with the main contact. A switching circuit is electrically coupled to the control coil and the solid state DC switch, the switching circuit configured to energize the control coil and to turn ON the solid state DC switch.

In accordance with another aspect of the invention, a system to provide DC arcless switching and isolation of a DC electrical power is provided. The system comprises a first contactor, the first contactor including a control coil and a main contact, the main contact including an open position and a closed position, the main contact forming an air gap so that no current flows through the first contactor when the main contact is in the open position, and the main contact forming a current flow path through the first contactor when the main contact is in the closed position. One or more mirror contacts are mechanically coupled to the first contactor. A solid state DC switch is electrically coupled to and in series with the main contact and forming a series flow path, the solid state DC switch including an ON state and an OFF state. A switching circuit is electrically coupled to the control coil and the solid state DC switch, the switching circuit configured to energize the control coil and to turn ON the solid state DC switch.

In accordance with yet another aspect of the invention, a method for providing DC electrical power to a DC load is provided. The method comprises providing a mechanical contactor, the contactor including a control coil and a main contact, the main contact including an open position and a closed position, the main contact forming an air gap so that no current flows through the contactor when the main contact is in the open position, and the main contact forming a current flow path through the contactor when the main contact is in the closed position; electrically coupling the main contact to the DC load; providing a solid state DC switch electrically coupled to and in series with the main contact; electrically coupling the solid state DC switch to the DC electrical power; providing a control power to energize the control coil and close the main contact first; and after closing the main contact, providing a turn ON signal to the solid state DC switch to provide the DC electrical power to the DC load.

To the accomplishment of the foregoing and related ends, the embodiments, then, comprise the features hereinafter fully described. The following description and the annexed drawings set forth in detail certain illustrative aspects of the invention. However, these aspects are indicative of but a few of the various ways in which the principles of the invention can be employed. Other aspects, advantages and novel features of the invention will become apparent from the following detailed description of the invention when considered in conjunction with the drawings.

BRIEF DESCRIPTION OF THE SEVERAL VIEWS OF THE DRAWINGS

The embodiments will hereafter be described with reference to the accompanying drawings, wherein like reference numerals denote like elements, and:

FIG. 6 is a flow chart showing the steps of turning the safety isolation system of FIG. 2 ON.

DETAILED DESCRIPTION OF THE INVENTION

The various aspects of the present embodiments will be described in connection with various systems for control of industrial automation applications. That is because the features and advantages that arise due to the embodiments are well suited to this purpose. For this reason, the systems and methods will be described in the context of a safety isolation system. Still, it should be appreciated that the various aspects of the invention can be applied to achieve other objectives as well. For example, the systems and methods of the present invention may include the addition of mirror contacts, and may be combined with other control equipment and application specific devices, as non-limiting examples, for the same or similar purposes.

In at least some embodiments, the present invention can be part of a safety isolation system used to protect human life and limb in an industrial or other environment. Nevertheless, the term "safety" as used herein is not a representation that the present invention will make an industrial or other process safe or that other systems will produce unsafe operation. Safety in an industrial or other process depends on a wide variety of factors outside of the scope of the present invention including, for example: design of the safety system, installation and maintenance of the components of the safety system, and the cooperation and training of individuals using the safety system. Although the present invention is intended to be highly reliable, all physical systems are susceptible to failure and provision must be made for such failure.

In order to implement the safety isolation system, a number of technical problems need to be solved. For example, it would be desirable to provide the user with a way to switch DC electrical power with little or no arc, and without any undesirable leakage currents. In addition, the incorporation of mirror contacts to the system would provide added safety-related circuits adapted to provide a reliable indication about the open/closed status of the main contacts of a contactor, which may be useful to identify the possibility of DC electrical power or leakage currents.

Figure 1:
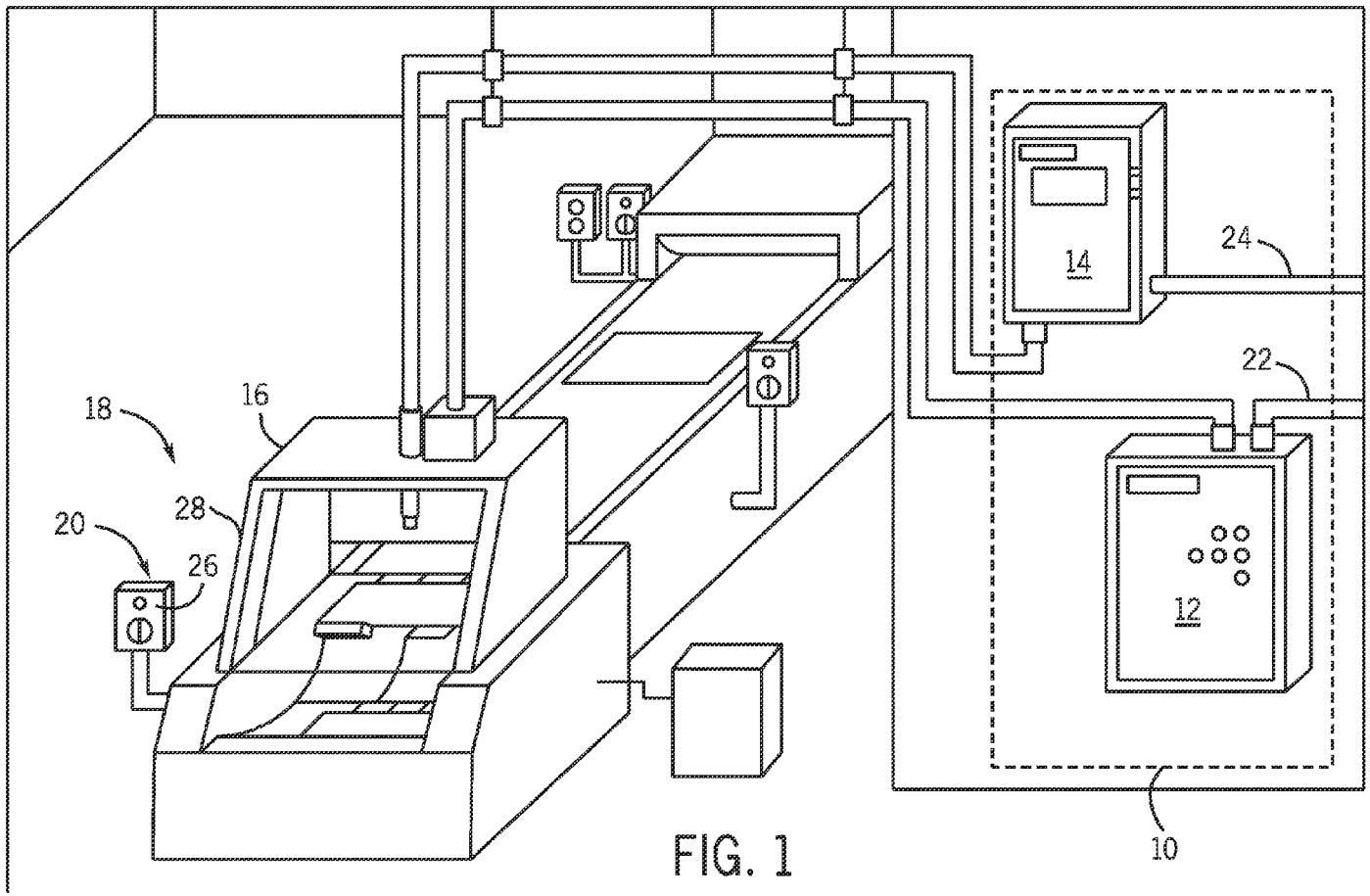
FIG. 1 BACKGROUND ART
FIG. 1 is a perspective view of a prior known industrial automation system employing a control system that is capable of connecting and disconnecting and isolating a low voltage AC electrical power.
Figure 2:
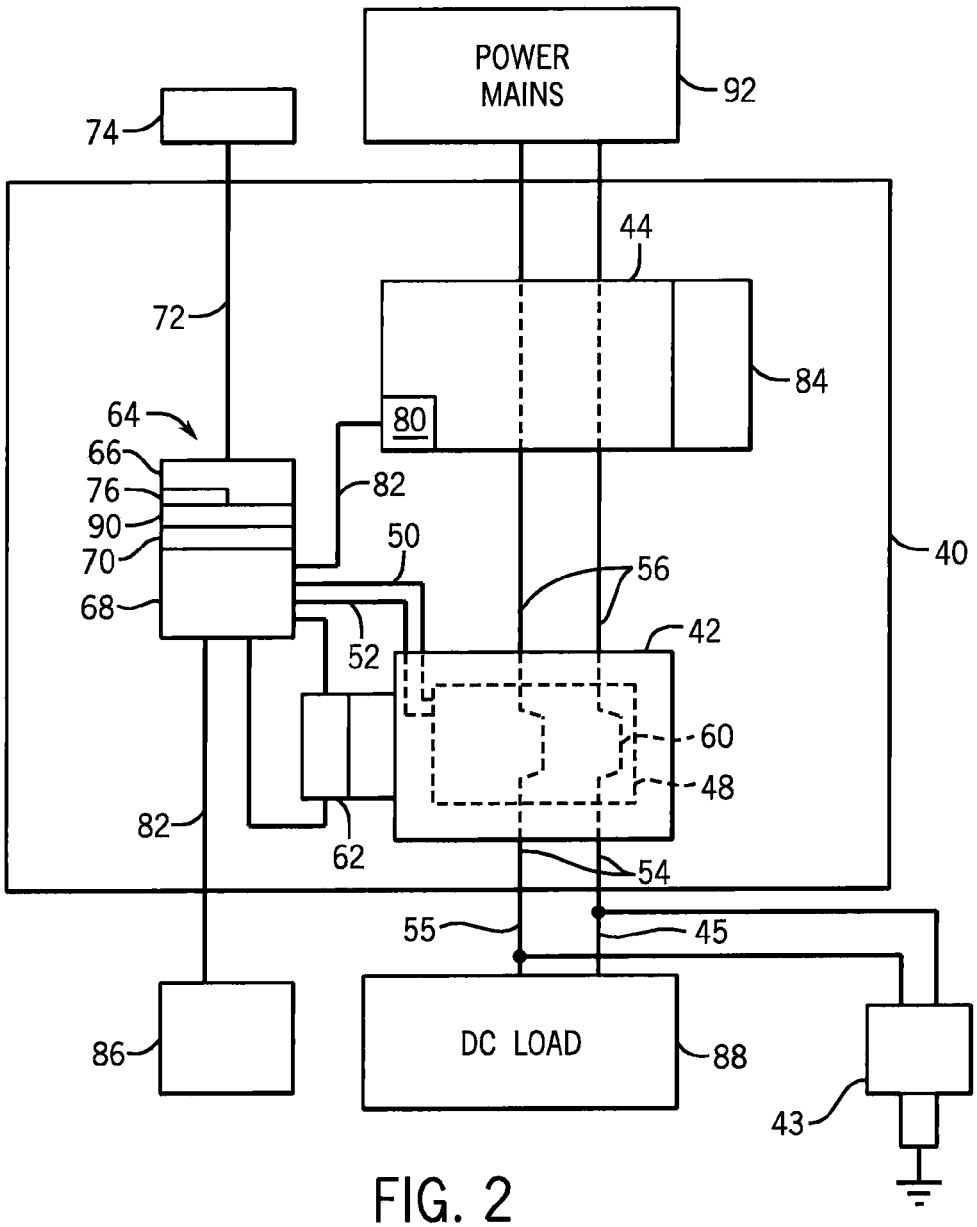
FIG. 2 shows in schematic form an improved safety isolation system in accordance with the present embodiments, where the safety isolation system is configured to connect and disconnect and isolate a DC electrical power.

FIG. 2 shows an exemplary embodiment of a safety isolation system 40 for switching DC electrical power 92 in an industrial automation environment. System 40 is shown positioned between high voltage DC power mains 92 and a DC load 88.

As seen in FIG. 2, the schematic representation of the safety isolation system 40 shows a high voltage solid state DC switch 44 in series with a mechanical contactor 42 to provide a series flow path 45. The contactor 42 serves to provide an air gap 46 (see FIG. 3) for electrical isolation and the solid state DC switch provides arcless switching of the DC electrical power, including high voltage DC electrical power. It is to be appreciated that the contactor 42 and the solid state DC switch 44 may comprise individual components electrically wired together, or, they may be combined into one common housing to provide an integral device. It is also to be appreciated that the contactor may comprise a contactor designed for AC electrical power (an AC contactor), or a contactor designed for DC electrical power (a DC contactor), or a special purpose contactor.

Figure 3:
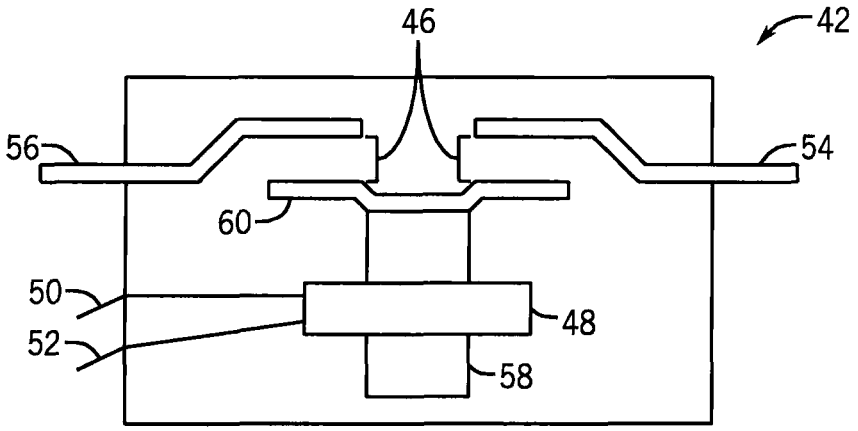
FIG. 3 shows in schematic form a side cross section of a contactor.

In one embodiment, the contactor 42 may be a single pole contactor and comprise a control coil 48, control wire connectors 50 and 52, an incoming power wire connector 56, an outgoing power wire connector 54, and a movable armature 58 to electrically connect the incoming and outgoing power wire connectors via a main contact 60 (see FIG. 3). In an alternative embodiment, the mechanical contactor 42 may be a multi-pole contactor, such as a two pole contactor as seen in FIG. 2, and comprise a control coil 48, control wire connectors 50 and 52, a plurality of incoming power wire connectors 56, a plurality of outgoing power wire connectors 54, and a moveable armature 58 (shown in FIG. 3) to connect the incoming and outgoing power wire connectors via a plurality of main contacts 60.

Figure 4:
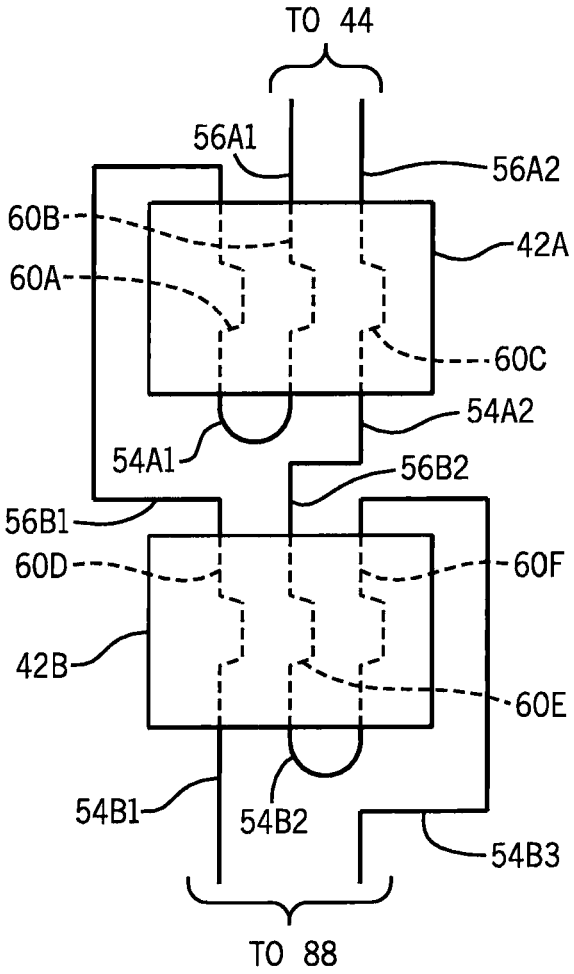
FIG. 4 shows in schematic form use of two contactors and an alternative wiring configuration usable with the improved safety isolation system in accordance with the present embodiments.

In an alternate embodiment, there could be a plurality of contactors, such as single pole, two pole, or three pole, for example, all wired in series with the solid state DC switch 44. FIG. 4 shows one possible wiring configuration using two, three pole contactors 42A and 42B. As seen, one incoming power wire 56A1 (coming from the solid state DC switch 44)

is coupled to the main contact 60B in contactor 42A, and the outgoing power wire 54A1 comes from main contact 60B and is jumpered as an input to main contact 60A. Incoming power wire 56B1 comes off of main contact 60A and is coupled to main contact 60D on contactor 42B. Outgoing power wire 54B1 comes off of main contact 60D and goes to the DC load 88. The other incoming power wire 56A2 (coming from the solid state DC switch 44) is coupled to main contact 60C of contactor 42A. Outgoing power wire 54A2 comes off of main contact 60C and becomes the input power wire 56B2 coupled to main contact 60E in contactor 42B. The outgoing power wire 54B2 off of main contact 60E is also jumpered as an input to main contact 60F. Outgoing power wire 54B3 comes off of main contact 60F and goes to the DC load 88.

One or more (typically a pair) of optional mirror contacts 62 may be mechanically coupled to the contactor 42 to provide an indication about the open/closed status of the main contacts 60 of the contactor 42. It is to be appreciated that mirror contacts may be preferred due to their strict specifications for reliability, but known auxiliary contacts may also be incorporated in place of or in addition to the mirror contacts. The control coil 48 is used to magnetically actuate/move the armature 58. The armature moves to mechanically open and close the main contacts 60 and the optional mirror contacts 62.

Figure 5:
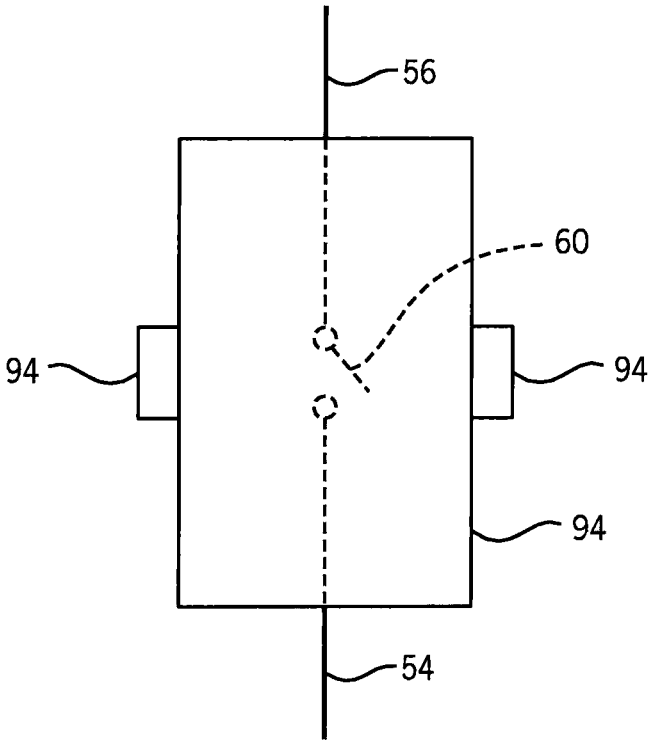
FIG. 5 shows in schematic form a sensor adapted to sense the open/closed status of a contact inside a hermetically sealed container.

Referring to FIG. 5, in place of, or in addition to mirror contacts 62, an electronics based sensing device 94 may be used to sense the open/closed status of the main contacts 60. In certain embodiments incorporating one or more contactors that utilize the hermetically sealed containers 96 as previously described, the hermetically sealed containers 96 may be generally transparent. Optoelectronics (such as a laser and/or photo transceiver, and/or optical sensors, as non-limiting examples) may be used as the sensor 94 to image or detect the status of the main contact 60 within the container 96. Alternatively, the sensor 94 may not require a transparent container 96 and may sense the status of the main contact 60 using electronic or magnetic sensors.

A switching circuit 64 may be used to provide power and control to the safety isolation system 40. The switching circuit 64 may include a number of assemblies, including a power supply 66, a control circuit 68, and a fault protection circuit 70. It is to be appreciated that switching circuit 64 may be one circuit, or multiple circuits, and may be incorporated with the solid state DC switch 44 or with the contactor 42, or may be a separate assembly electrically coupled to the solid state DC switch 44 and the contactor 42.

The power supply 66 may be adapted to accept user input voltage 72 from an external control power source 74, such as a control power or a line power readily available within an industrial automation environment in either VAC and/or VDC, and then configure the input voltage 72 to an output or system voltage 76 that may then be supplied to the control circuit 68 and/or the fault protection circuit 70.

The control circuit 68 uses the system voltage 76 to provide power to a gate device 80 known in the art. The gate device operates to open and close the solid state DC switch 44 in a known manner. When the gate device 80 is turned ON (by receiving a turn ON signal 82 from the control circuit 68), the solid state DC switch 44 closes, and when the gate device 80 is turned OFF (by removing the turn ON signal), the solid state DC switch 44 opens.

It is to be appreciated that the solid state DC switch 44 may be a variety of power components used for performing an electrical switching function. For example, these components can be transistors of MOSFET, IGBT, BIPOLAR or JFET type, and may be made of silicon or silicon carbide, for example. Desirably, although not required, embodiments of the solid state DC switch 44 include fast turn on times and turn off times in the range of microseconds instead of milliseconds. A typical solid state DC switch 44 may contain silicon, which produces heat when the switch is closed. The system 40 may include a heat sink 84 so that the solid state DC switch 44 is prevented from overheating and remains within an appropriate operating temperature. The solid state DC switch 44 is a transistor-based switch, and carries the risk that even if open (turned OFF), a partial flow of current can still cross the switch.

An input control device 86, such as a programmable logic controller or a manually operated switch, as non-limiting examples, may be used to provide the turn ON or turn OFF signal to the switching circuit 64 to supply or remove the turn ON signal 82 and signal to the control coil 48 to turn ON or turn OFF contactor 42.

Figure 6:
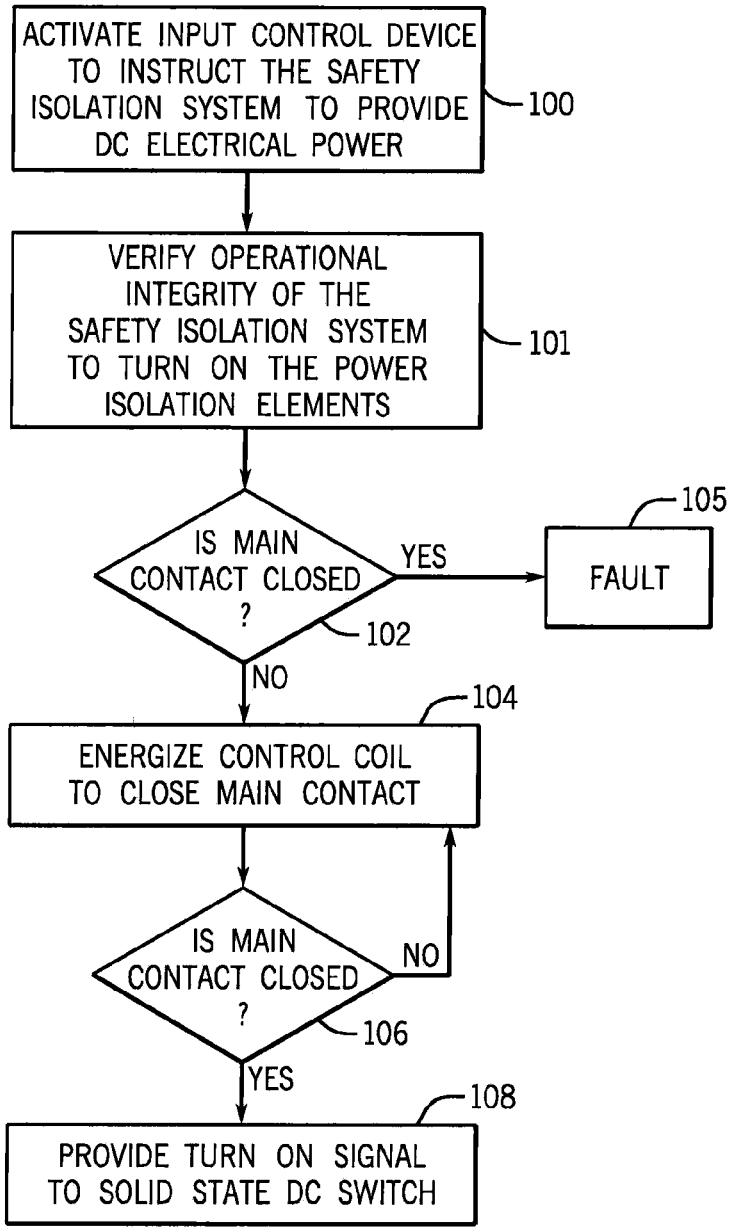

The steps performed to turn the safety isolation system 40 power isolation elements ON while practicing an exemplary embodiment of the invention consistent with the embodiments described herein are set forth in FIG. 6. Referring particularly to FIG. 6, the input control device 86 is activated to instruct the system 40 to provide DC electrical power to a DC load 88, as indicated at process block 100. After the input control device is activated but before the power isolation elements (the solid state DC switch and the contactor(s)) are turned on, the system 40 may verify the operational integrity of the system 40 and its ability to turn on the power isolation elements, as indicated at process block 101. During and/or after the system verifies its operational integrity, the control circuit 68 may monitor the status of the contactor 42 and/or the mirror contacts 62 to determine if the main contact(s) 60 are already closed, as indicated at decision block 102. If the main contacts 60 are open, the control circuit 68 provides the system power 76 to the control coil 48 of the contactor 42 to close the main contacts 60 of the contactor 42, as indicated at process block 104. If the main contacts 60 are closed, the control circuit 68 then detects a fault, such as a contact weld may have occurred, as indicated at process block 105. The solid state switch 44 is inhibited from turning ON and the control circuit 68 takes appropriate action for the fault.

Prior to the control coil 48 receiving the system power 76, the main contacts 60 are open, and no current flows through either the solid state DC switch 44 or the contactor 42 because of the air gap 46 in the contactor 42.

Being mechanically coupled to the contactor 42, the mirror contacts 62 change state, meaning they open if they are normally closed, when the control coil 48 receives the system power to close the main contacts 60. With the serial current flow path 45 of the present embodiments, the voltage across the main contacts 60 is zero or close to zero when the main contacts 60 are closing. This prevents or significantly reduces arcing when the main contacts 60 close, and also increases the life of the contacts.

The control circuit 68 may monitor the status of the contactor 42 and/or the mirror contacts 62 to confirm that the main contacts 60 have closed, as indicated at decision block 106. If the main contacts have not closed, one or more attempts may be made to provide the system power 76 to the control coil 48 of the contactor 42 to close the main contacts 60. Once the control circuit 68 has confirmed that the main contacts 60 have closed, the control circuit 68 then provides the turn ON signal 82 to the gate device 80 to close the solid state DC switch 44, thereby closing the series flow path 45 and allowing high voltage DC electrical power to flow through the system 40 and to the load 88, as indicated at process block 108. The control circuit 68 may also monitor the solid state DC switch 44 to confirm that the switch has turned ON.

Once the main contacts 60 are closed, and the mirror contacts 62 change state, the solid state DC switch 44 is turned ON. The turning ON (and OFF) of the solid state DC switch 44 can be based on either timing or feedback parameters, such as within a predetermined amount of time, or not before confirmation of contactor status is made via the mirror contacts 62. Despite the criteria used for the decision, the control circuit 68 would still make the decision about when to turn ON and OFF the solid state DC switch 44.

Figure 7:
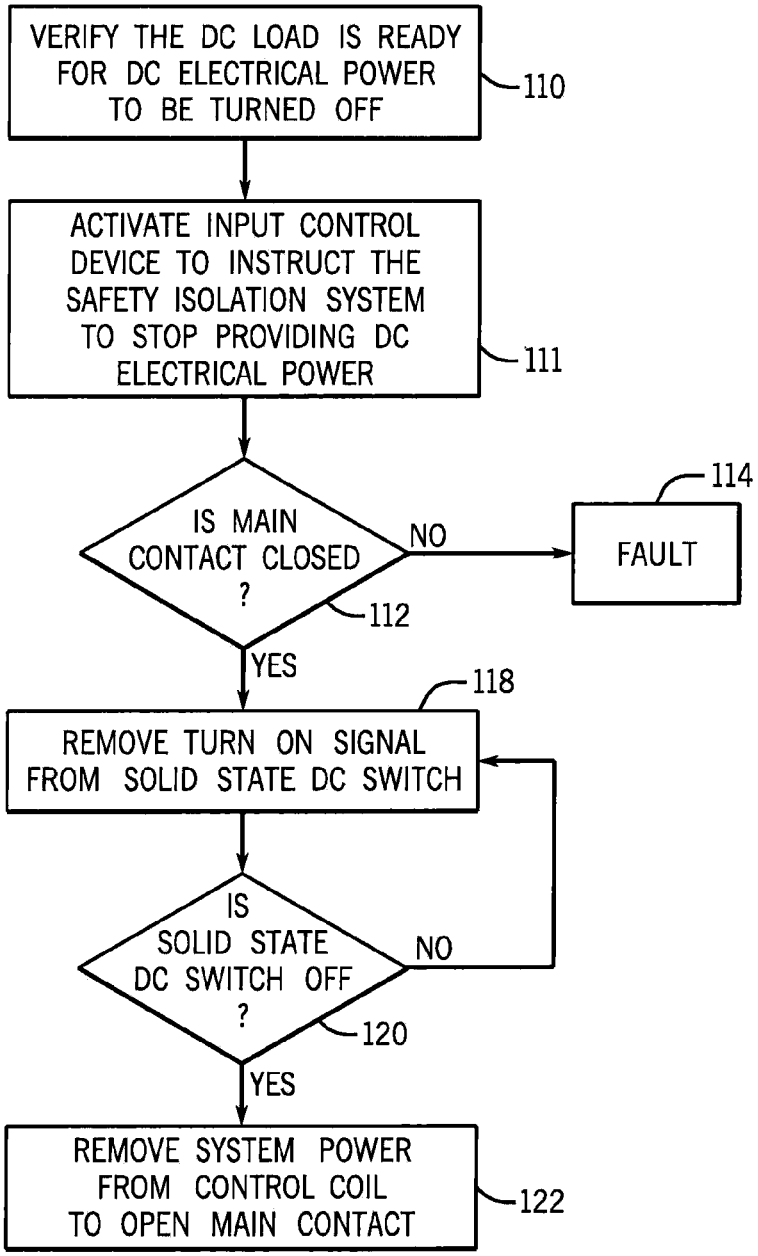
FIG. 7 is a flow chart showing the steps of turning the safety isolation system of FIG. 2 OFF.

The steps performed to turn the safety isolation system 40 power isolation elements OFF while practicing an exemplary embodiment of the invention consistent with the embodiments described herein are set forth in FIG. 7. Referring particularly to FIG. 7, an optional fist step may be to verify that the DC load 88 is ready for the DC electrical power to be turned OFF, as indicated at process block 110. In some production processes, the process or production run should be competed before power is removed to the industrial automation equipment (the load), so that the production run can be completed. The next step is to activate the input control device 86 to instruct the system 40 to stop providing DC electrical power to the DC load 88, as indicated at process block 111. When the input control device 86 is activated to instruct the system 40 to stop providing DC electrical power to the load 88, the control circuit 68 may monitor the status of the contactor 42 and/or the mirror contacts 62 to determine if the main contacts 60 are closed, as indicated at decision block 112. If the main contacts are open, the control circuit 68 takes appropriate action for the fault, as indicated at process block 114. If the main contacts 60 are determined to be closed, the control circuit 68 removes the turn ON signal 82 from the gate device 80 to turn the solid state DC switch 44 OFF, thereby opening the circuit 45 and stopping the DC electrical power from flowing through the system 40 and to the load 88, as indicated at process block 118.

The control circuit 68 may also continue to monitor the solid state DC switch 44 to confirm that the switch has turned OFF, as indicated at decision block 120. Because the contactor 42 is still closed, DC electrical power is still available to the solid state DC switch 44. At this point, a small amount of DC electrical power may still leak through the solid state DC switch. Opening the contactor 42 eliminates any leakage current through the solid state DC switch and isolates the load 88 from the DC electrical power. Once the control circuit 68 has confirmed that the solid state DC switch 44 has turned OFF, the control circuit 68 then removes the system power 76 to the control coil 48 of the contactor 42 to open the main contacts 60, as indicated at process block 122. If the solid state DC switch 44 has not turned OFF, one or more attempts may be made to remove the turn ON signal 82 from the gate device 80.

Optionally, the system 40 may be configured to ground the outgoing power wires 55 after the solid state DC switch 44 has been turned OFF and system power 76 has been removed from the control coil 48 of the contactor 42. As seen in FIG. 2, grounding contactor 43 may be wired in parallel with the load 88. When contactor 43 is energized, outgoing power lines 55 are electrically connected to isolated ground.

Similar to the turning ON process described above, when the control circuit 68 removes the system power 76 from the control coil 48 to open the main contacts 60, the mirror contacts 62 again change state, meaning they close if they were open. As previously indicated, with the series flow path 45 of the present embodiments, the voltage across the main contacts 60 is zero or close to zero when the contacts 60 are opening. This prevents or significantly reduces any DC arcing when the main contacts 60 open, and also increases the life of the contacts. The control circuit 68 may also monitor the state of the contactor 42 and/or the mirror contacts 62 to confirm that the main contacts 60 of the contactor 42 have opened.

As previously described, when the switching circuit 64 receives an indication to close the main contacts 60, the control circuit 68 first checks to make sure that the main contacts 60 are actually opened. The control circuit 68 may check the status of the mirror contacts 62 to obtain confirmation that the main contacts 60 are actually open. If main contacts 60 are already closed, then the command to close the main contacts 60 is cancelled and the control circuit 68 takes appropriate action for the fault. If the main contacts are found to be open, the control circuit 68 turns ON the solid state DC switch 44 and then closes the main contacts 60 as described above.

When the switching circuit 64 receives an indication to open the main contacts 60, it similarly confirms that the main contacts 60 are actually closed. If the main contacts 60 are already open, the control circuit 68 takes appropriate action for the fault. The switching circuit 64 then checks to make sure that the turn ON signal 82 to the solid state DC switch has been removed. If the switching circuit 64 receives confirmation from the mirror contacts 62 that the main contacts 60 are actually closed, the control circuit 68 turns the solid state DC switch OFF, and then opens the main contacts 60 as described above.

The switching circuit 64 may also include fault protection. If a condition exists where the system 40 looses user input power 72 to the switching circuit 64, the system 40 desirably maintains a sufficient amount of energy to hold the main contacts 60 closed until the solid state DC switch 44 can be turned OFF (the turn ON signal 82 is removed from the gate device 80). In one embodiment, the power supply 66 or the system 40 may be configured to include standby power, e.g., an uninterruptible power supply, a constant voltage transformer, a standby capacitor or battery 90, for providing the sufficient amount of energy to hold the main contacts 60 closed until the solid state DC switch 44 can be turned OFF.

Therefore, safety isolation systems and methods adapted for switching DC electrical power applications, including high voltage DC, are provided. A contactor is in series with a solid state DC switch and a switching circuit controls the operation of the contactor and the solid state DC switch. It is contemplated that mirror contacts may be added to the system that are capable of providing a reliable indication about the open/closed status of the main contacts of the contactor.

The foregoing has been a detailed description of illustrative embodiments of the invention. Various modifications and additions can be made without departing from the spirit and scope thereof. Furthermore, since numerous modifications and changes will readily occur to those skilled in the art, it is not desired to limit the invention to the exact construction and operation shown and described. For example, any of the various features described herein can be combined with some or all of the other features described herein according to alternate embodiments. While the preferred embodiment has been described, the details may be changed without departing from the invention, which is defined by the claims.

Finally, it is expressly contemplated that any of the processes or steps described herein may be combined, eliminated, or reordered. In other embodiments, instructions may reside in computer readable medium wherein those instructions are executed by a processor to perform one or more of processes or steps described herein. As such, it is expressly contemplated that any of the processes or steps described herein can be implemented as hardware, software, including program instructions executing on a computer, or a combination of hardware and software. Accordingly, this description is meant to be taken only by way of example, and not to otherwise limit the scope of this invention.

I claim:

1. A safety isolation system to connect, disconnect, and isolate a DC electrical power, the system comprising:

at least one mechanical contactor, the contactor including a control coil and a main contact, the main contact including an open position and a closed position, the main contact forming an air gap so that no current flows through the contactor when the main contact is in the open position, and the main contact forming a current flow path through the contactor when the main contact is in the closed position;

a solid state DC switch electrically coupled to and in series with the main contact;

a switching circuit electrically coupled to the control coil and the solid state DC switch, the switching circuit configured to energize the control coil and to turn ON the solid state DC switch; and wherein the switching circuit is adapted to confirm that the main contact is in the closed position by monitoring the status of a sensor on the contactor, the sensor adapted to sense the status of the main contact, the sensor being electrically isolated from the DC electrical power.

2. The system according to claim 1:

wherein the switching circuit is adapted to receive an instruction to allow DC current to flow through the safety isolation system, and when the switching circuit receives the instruction to allow DC current to flow through the safety isolation system, the switching circuit is adapted to provide a control power to energize the control coil to close the main contact first, and then the switching circuit is adapted to provide a turn ON signal to the solid state DC switch after the control coil has been energized.

3. The system according to claim 2:

wherein the switching circuit provides the turn ON signal to the solid state DC switch only after confirming that the main contact is in the closed position.

4. The system according to claim 1:

wherein the switching circuit is adapted to receive an instruction to stop DC current from flowing through the safety isolation system, and when the switching circuit receives the instruction to stop DC current from flowing through the safety isolation system, the switching circuit is adapted to turn OFF the solid state DC switch first, and then the switching circuit is adapted to remove a control power to de-energize the control coil to open the main contact after the solid state DC switch has been turned OFF.

5. The system according to claim 1:

wherein the switching circuit comprises a control circuit, the control circuit adapted to provide a turn ON signal to the solid state DC switch.

6. The system according to claim 1:

wherein the contactor is at least one of an AC contactor, a DC contactor, and a definite purpose contactor.

7. The system according to claim 1:

wherein the switching circuit is electrically coupled to a gate device, the gate device adapted to turn ON and turn OFF the solid state DC switch.

8. The system according to claim 1:

wherein the switching circuit is adapted to confirm that the main contact is in the closed position by monitoring the status of one or more auxiliary contacts on the contactor.

9. The system according to claim 1:

wherein the switching circuit is adapted to confirm that the main contact is in the closed position by monitoring the status of one or more mirror contacts mechanically coupled to the contactor.

10. The system according to claim 1:

wherein the main contact is enclosed in a hermetically sealed container.

11. The system according to claim 1:

wherein the sensor is at least one of a optoelectronics sensor, an electronic sensor, and a magnetic sensor.

12. A safety isolation system to connect, disconnect, and isolate a DC electrical power, the system comprising:

at least one mechanical contactor, the contactor including a control coil and a main contact, the main contact including an open position and a closed position, the main contact forming an air gap so that no current flows through the contactor when the main contact is in the open position, and the main contact forming a current flow path through the contactor when the main contact is in the closed position;

a solid state DC switch electrically coupled to and in series with the main contact;

a switching circuit electrically coupled to the control coil and the solid state DC switch, the switching circuit configured to energize the control coil and to turn ON the solid state DC switch; and wherein the switching circuit comprises a fault protection circuit, the fault protection circuit adapted to maintain a predetermined amount of energy such that when user input power is lost to the switching circuit, the fault protection circuit is adapted to hold the main contact in the closed position until the solid state DC switch can be turned OFF.

13. The system according to claim 12:

wherein the predetermined amount of energy is stored in at least one of an uninterruptible power supply, a constant voltage transformer, a capacitor, and a battery.

14. A system to provide DC arcless switching and isolation of a DC electrical power, the system comprising:

a first contactor, the first contactor including a control coil and a main contact, the main contact including an open position and a closed position, the main contact forming an air gap so that no current flows through the first contactor when the main contact is in the open position, and the main contact forming a current flow path through the first contactor when the main contact is in the closed position;

one or more mirror contacts mechanically coupled to the first contactor;

a solid state DC switch electrically coupled to and in series with the main contact and forming a series flow path, the solid state DC switch including an ON state and an OFF state;

a switching circuit electrically coupled to the control coil and the solid state DC switch, the switching circuit configured to energize the control coil and to turn ON the solid state DC switch; and wherein the switching circuit is adapted to confirm that the main contact is in the closed position by monitoring the status of a sensor on the contactor, the sensor adapted to sense the status of the main contact, the sensor being electrically isolated from the DC electrical power.

15. The system according to claim 14:

wherein the DC electric power is at 220 VDC or greater.

16. The system according to claim 14:

further including a second contactor, the second contactor including a control coil and a main contact, the main contact of the second contactor forming an air gap so that no current flows through the second contactor when the main contact of the second contactor is in an open position, the main contact of the second contactor being electrically coupled to and in series with the main contact of the first contactor and the solid state DC switch.

17. The system according to claim 16:

wherein when the solid state DC switch DC switch is in the OFF state, the series flow path includes at least the first contactor air gap and the second contactor air gap.

18. A method for providing DC electrical power to a DC load, the method comprising:

providing a mechanical contactor, the contactor including a control coil and a main contact, the main contact including an open position and a closed position, the main contact forming an air gap so that no current flows through the contactor when the main contact is in the open position, and the main contact forming a current flow path through the contactor when the main contact is in the closed position;

electrically coupling the main contact to the DC load;

providing a solid state DC switch electrically coupled to and in series with the main contact;

electrically coupling the solid state DC switch to the DC electrical power;

providing a control power to energize the control coil and close the main contact first;

after closing the main contact, providing a turn ON signal to the solid state DC switch to provide the DC electrical power to the DC load; and providing a switching circuit for confirming that the main contact is in the closed position by monitoring the status of a sensor on the contactor, the sensor sensing the status of the main contact, the sensor being electrically isolated from the DC electrical power.

19. The method according to claim 18:

wherein the switching circuit is electrically coupled to the control coil and the solid state DC switch, the switching circuit configured to energize the control coil and to turn ON the solid state DC switch.

20. The method according to claim 18:

further including confirming that the main contact is closed before providing the turn ON signal to the solid state DC switch.

21. The method according to claim 20:

further including mechanically coupling one or more mirror contacts to the contactor for confirming that the main contact is closed, the one or more mirror contacts adapted to not reclose when the control power is removed from the control coil of the contactor if the main contact is welded.

22. A system to provide DC arcless switching and isolation of a DC electrical power, the system comprising:

a first contactor, the first contactor including a control coil and a main contact, the main contact including an open position and a closed position, the main contact forming an air gap so that no current flows through the first contactor when the main contact is in the open position, and the main contact forming a current flow path through the first contactor when the main contact is in the closed position;

one or more mirror contacts mechanically coupled to the first contactor;

a solid state DC switch electrically coupled to and in series with the main contact and forming a series flow path, the solid state DC switch including an ON state and an OFF state;

a switching circuit electrically coupled to the control coil and the solid state DC switch, the switching circuit configured to energize the control coil and to turn ON the solid state DC switch; and wherein the switching circuit comprises a fault protection circuit, the fault protection circuit adapted to maintain a predetermined amount of energy such that when user input power is lost to the switching circuit, the fault protection circuit is adapted to hold the main contact in the closed position until the solid state DC switch can be turned OFF.

23. A method for providing DC electrical power to a DC load, the method comprising:

providing a mechanical contactor, the contactor including a control coil and a main contact, the main contact including an open position and a closed position, the main contact forming an air gap so that no current flows through the contactor when the main contact is in the open position, and the main contact forming a current flow path through the contactor when the main contact is in the closed position;

electrically coupling the main contact to the DC load;

providing a solid state DC switch electrically coupled to and in series with the main contact;

electrically coupling the solid state DC switch to the DC electrical power;

providing a control power to energize the control coil and close the main contact first;

after closing the main contact, providing a turn ON signal to the solid state DC switch to provide the DC electrical power to the DC load; and providing a switching circuit having a fault protection circuit, the fault protection circuit maintaining a predetermined amount of energy such that when user input power is lost to the switching circuit, the fault protection circuit operating to hold the main contact in the closed position until the solid state DC switch is turned OFF.

* * * * *